US010654550B2

(12) United States Patent
Pikor

(10) Patent No.: US 10,654,550 B2
(45) Date of Patent: May 19, 2020

(54) EXPANDING FLOW NOZZLE

(71) Applicant: Raytheon Company, Waltham, MA (US)

(72) Inventor: Emily J. Pikor, Bristol, RI (US)

(73) Assignee: Raytheon Company, Waltham, MA (US)

( * ) Notice: Subject to any disclaimer, the term of this patent is extended or adjusted under 35 U.S.C. 154(b) by 45 days.

(21) Appl. No.: 15/895,304

(22) Filed: Feb. 13, 2018

(65) Prior Publication Data

US 2019/0248458 A1 Aug. 15, 2019

(51) Int. Cl.

| | |
|---|---|
| ***B63G 8/20*** | (2006.01) |
| ***B63G 8/00*** | (2006.01) |
| *B63H 11/113* | (2006.01) |

(52) U.S. Cl.

CPC ..... *B63G 8/20* (2013.01); *B63G 8/001* (2013.01); *B63G 2008/002* (2013.01); *B63G 2008/008* (2013.01); *B63H 11/113* (2013.01)

(58) Field of Classification Search

CPC ..... B63H 11/113; B63H 11/10; B63H 11/06; B63G 8/14; B63G 8/16; B63G 8/18

See application file for complete search history.

(56) References Cited

U.S. PATENT DOCUMENTS 2,983,244 A * 5/1961 Young ..... A63H 23/06 440/23

3,710,748 A 1/1973 Baer et al.

5,267,883 A * 12/1993 Gudmundsen ..... B63H 11/06 440/38

6,089,177 A 7/2000 Müller (Continued)

FOREIGN PATENT DOCUMENTS

| | | |
|---|---|---|
| DE | 198 40 078 B4 | 3/2000 |
| FR | 1312353 | 12/1962 |
| GB | 10082 | 5/1899 |

OTHER PUBLICATIONS

"*Pratt & Whitney's F119 Powers F-22 Raptor to 500,000 Engine Flight Hours*," Pratt & Whitney MediaRoom; Paris Air Show, Jun. 20, 2017; Retrieved from http://newsroom.pw.utc.com/2017-06-20-Pratt-Whitneys-F119-Powers-F-22-Raptor-to-500-000-Engine-Flight-Hours; 3 Pages.

(Continued)

*Primary Examiner* — Andrew Polay

(74) *Attorney, Agent, or Firm* — Daly, Crowley, Mofford & Durkee LLP

(57) ABSTRACT

Disclosed are an improved nozzle for an unmanned underwater vehicle (UUV), and a method for operating the same. The nozzle includes a first rigid member operatively coupled to a UUV steering mechanism. The nozzle also has a second rigid member, coupled to the first rigid member by a flexible bellows according to a configurable operating angle. The nozzle does not extend beyond a bounding surface when stored but does when deployed. Water traversing the first rigid member and contacting the second rigid member produces a reactive force according to the configurable operating angle. Simultaneous and independent control of the volume of fluid traversing several such nozzles in the UUV, and their respective orientations and operating angles, permits automatic station-keeping or navigation according to another guidance objective.

20 Claims, 7 Drawing Sheets

(56) References Cited

U.S. PATENT DOCUMENTS

| | | | |
|---|---|---|---|
| 6,571,725 | B1 | 6/2003 | Lee |
| 8,449,255 | B2 | 5/2013 | Tadayon et al. |
| 9,174,713 | B2 | 11/2015 | Item et al. |
| 9,394,804 | B2 | 7/2016 | Rusovici |
| 9,551,298 | B2 | 1/2017 | Binks et al. |
| 9,745,918 | B2 | 8/2017 | Gilson et al. |
| 2014/0213126 | A1 | 7/2014 | Item et al. |

OTHER PUBLICATIONS

"*F119-PW-100, Turbofan Engine*," Proven Power for the F-22 Raptor, Military Engines; Product Facts; 2016; Retrieved from http://www.pw.utc.com/Content/Press_Kits/pdf/me_f119_pCard.pdf; 2 Pages.

PCT International Search Report and Written Opinion dated Feb. 21, 2020 for International Application No. PCT/US2019/017250; 15 Pages.

* cited by examiner

EXPANDING FLOW NOZZLE

BACKGROUND

Unmanned underwater vehicles (UUVs) are used for a variety of purposes and can include cameras or other sensors to provide information about underwater objects. For example, UUVs are commonly used for inspection and data collection. A typical UUV includes a propulsion system for multi-axis flight control.

SUMMARY

Disclosed embodiments of the invention provide expandable, steerable nozzles including a flexible bellows that expands beyond the confines of a cylindrical storage or launch housing upon deployment. By expanding into the surrounding water, such nozzles advantageously provide larger openings and permit larger volumes of water to traverse them than do conventional fixed nozzles made from a single, rigid component. Embodiments of the inventive nozzles have been experimentally measured to produce a significant increase in total thrust, allowing mission objectives to be completed more quickly. Moreover, the disclosed nozzles are steerable, and thus, include multi-axis control advantages.

Thus, a first embodiment comprises an expandable, steerable nozzle for a device. In such an embodiment, the nozzle comprises a first component having a first rigid member mounted to the device and operatively coupled to a steering mechanism of the device. A second component comprises a second rigid member. A third component comprises a flexible bellows coupling the first rigid member to the second rigid member according to a configurable operating angle. In this way, a fluid traversing the first rigid member produces, upon contacting the second rigid member, a reactive force according to the operating angle. The flexible bellows has a first configuration in which the nozzle does not extend beyond a bounding surface, and a second configuration in which the nozzle extends beyond the bounding surface.

The expandable, steerable nozzle may be embodied in different variations, which may be alternate to or cumulative with each other. In a first variant, either or both of the first rigid member and the second rigid member comprises a plastic, a metal, a composite material, or any combination of these. In a second variant, the flexible bellows comprises a rubber, a flexible plastic, a fabric, or any combination of these. In a third variant, the steering mechanism of the device comprises a gear, and the first rigid member comprises a ring having teeth that mesh with teeth of the gear. In a fourth variant, the flexible bellows is shaped so that, in the second configuration of the nozzle, the operating angle is between 0 and 90 degrees, and may be approximately 15 degrees. A fifth variant further includes a third rigid member for retaining the nozzle to the steering mechanism, the third rigid member mechanically coupled to the second rigid member. The first rigid member may include a bearing for the third rigid member, and the third rigid member may be a rod comprising a metal, a plastic, a composite material, or any combination of these.

A second embodiment comprises an unmanned underwater vehicle (UUV) comprising a steering mechanism and an expandable, steerable nozzle as described above. The nozzle has a first rigid member operatively coupled to the steering mechanism of the UUV, a second rigid member, and a flexible bellows coupling the first rigid member to the second rigid member according to a configurable operating angle, so that a fluid traversing the first rigid member produces a reactive force according to the operating angle upon contacting the second rigid member. Also, as before, the flexible bellows has a first configuration in which the nozzle does not extend beyond a bounding surface, and a second configuration in which the nozzle extends beyond the bounding surface. Such a UUV may embody its nozzle according to the variations described above.

A third embodiment comprises a method of operating the UUV described above (or one of its variants). Such a method includes containing the UUV within a housing, containing including compressing, by an interior surface of the housing, the flexible bellows into a first configuration. The method may include ejecting the UUV from the housing, thereby causing the flexible bellows to expand into a second configuration having a different operating angle than the first configuration. The method also may include causing water to traverse the first rigid member and contact the second rigid member, wherein the fluid produces a reactive force according to the operating angle of the second configuration.

In one further variant, a method embodiment further includes controlling the position or orientation of a UUV according to a guidance objective by automatically varying a volume of the water traversing the first rigid member, automatically steering the reactive force using the steering mechanism, automatically varying the operating angle of the flexible bellows, or any combination thereof.

DESCRIPTION OF THE SEVERAL VIEWS OF THE DRAWINGS

The manner and process of making and using the disclosed embodiments may be appreciated by reference to the drawings, in which.

DETAILED DESCRIPTION

Figure 1A:
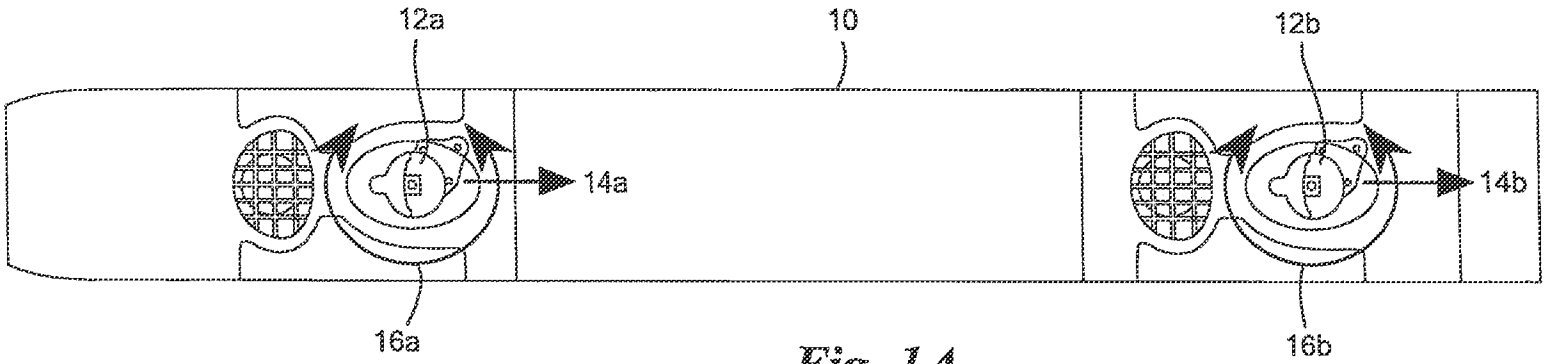
FIG. 1A is a side view of an exemplary unmanned underwater vehicle (UUV) embodiment of the invention.

FIG. 1 shows an exemplary unmanned underwater vehicle (UUV) embodiment of the invention. The side view 1A shows first and second expandable, steerable nozzles 12*a*, 12*b*. In accordance with illustrated embodiments, the UUV 10 may be stored in a stored configuration, in which the nozzles 12*a*, 12*b* do not extend beyond a bounding surface of the UUV 10, shown in FIG. 2 and described below in connection therewith. However, the nozzles 12*a*, 12*b* may be expanded in a so-called deployed or expanded configuration, in which a fluid traversing each such nozzle 12*a*, 12*b* produces a respective thrust 14*a*, 14*b*, 14*c*, and 14*d*. In the case of the UUV 10, the primary constituent of such a fluid is water, although other fluids may be used in other applications. In the deployed configuration, the respective thrusts 14*a*, 14*b* may be vectored or steered by rotating the nozzles 12*a*, 12*b* about an axis, as indicated by the directional rotation arrows 16*a*, 16*b*. Thus, the nozzles are both expandable and steerable.

Figure 1B:
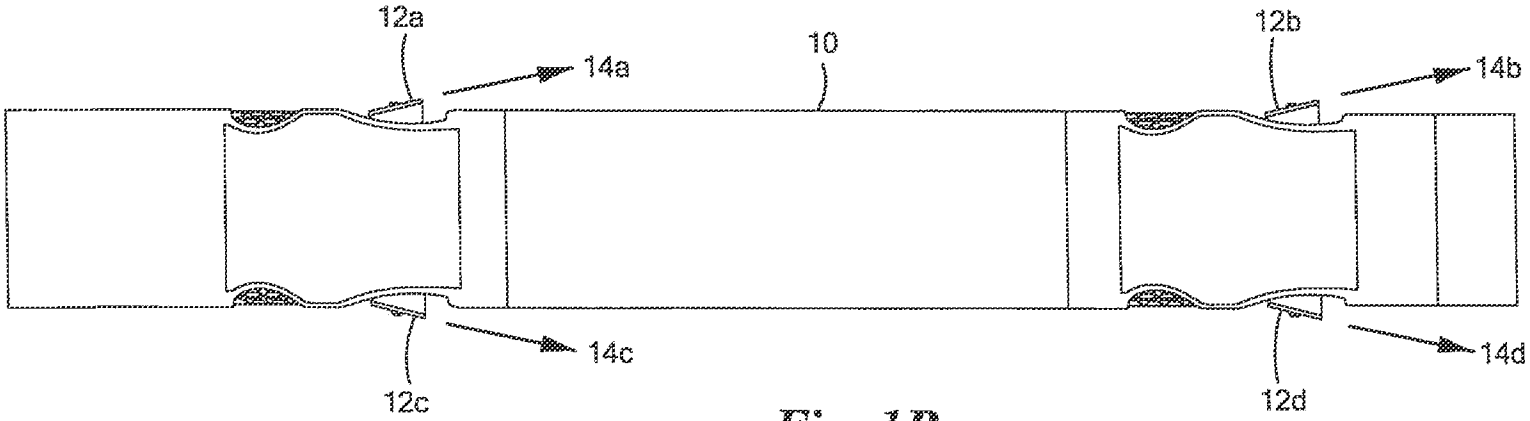
FIG. 1B is a top view of an exemplary unmanned underwater vehicle (UUV) embodiment of the invention.

It should be appreciated that the UUV 10 illustrated in FIG. 1 is only an exemplary device in which expandable, steerable nozzles may be embodied. Persons having ordinary skill in the art may conceive of other devices (such as lawn sprinklers, host attachments, and general fluid dispersion devices) in which such nozzles may be embodied without deviating from the inventive concepts described herein or the scope of the claims below. Moreover, a UUV 10 may be provided with any number or configuration of expandable, steerable nozzles. Thus, FIG. 1B is a top view of the UUV 10, showing four expandable, steerable nozzles 12*a*, 12*b*, 12*c*, 12*d* in two longitudinal rows, producing respective thrust vectors 14*a*, 14*b*, 14*c*, 14*d* on both the left and right sides of the UUV 10. In alternate embodiments, three or more such rows of nozzles may be provided, at equal or unequal angular displacements, while in other embodiments, nozzles are provided non-linearly or irregularly at points on the surface of the UUV 10.

Figure 2A:
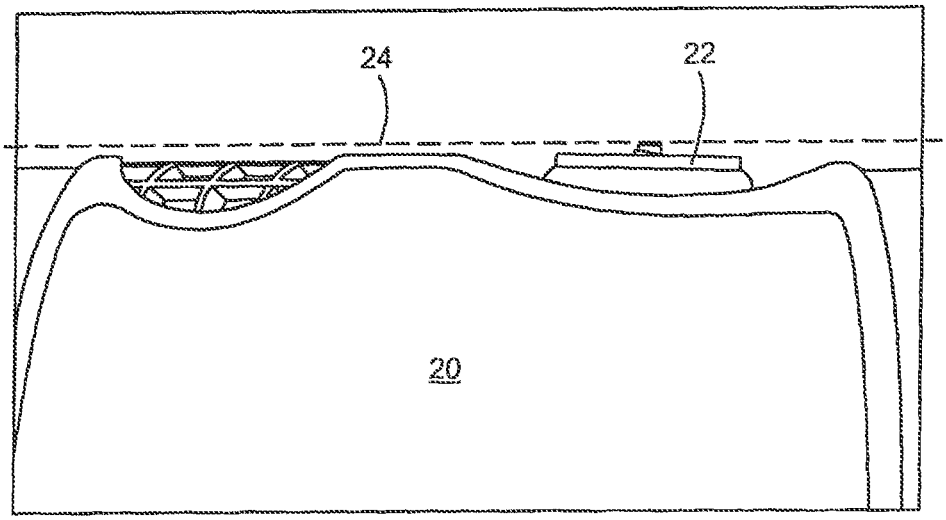
FIG. 2A is a top view of an enlargement of an area surrounding an expandable, steerable nozzle, in a stored configuration of the nozzle.
Figure 2B:
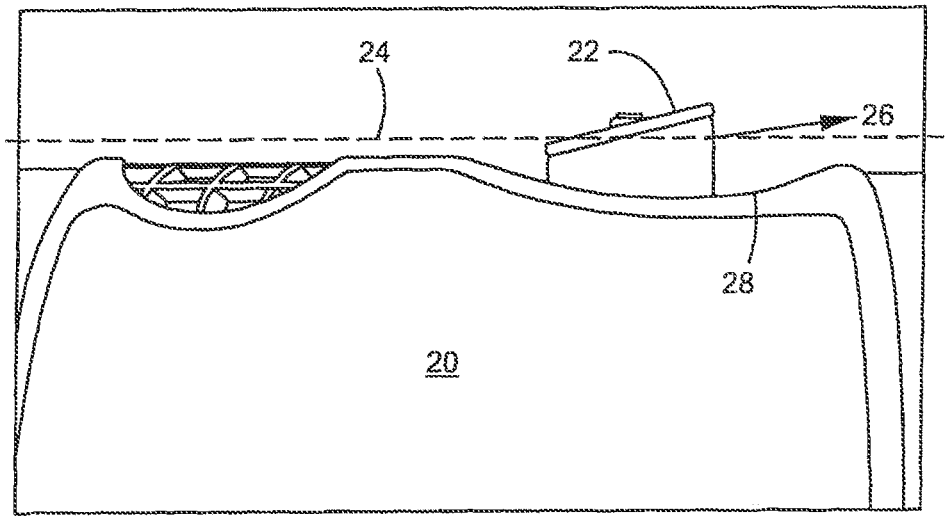
FIG. 2B is a top view of an enlargement of an area surrounding an expandable, steerable nozzle in a deployed configuration of the nozzle.

FIGS. 2A and 2B show an enlargement of an area, of a device 20, surrounding an expandable, steerable nozzle, in a top view 2A of a stored or compressed configuration of the nozzle, and in a top view 2B of a deployed or extended configuration of the nozzle. The device 20 may be the UUV 10 shown in FIG. 1, or some other device. The nozzle 22 shown in FIGS. 2A and 2B may be any of the nozzles 12*a*, 12*b*, 12*c*, 12*d* shown in FIG. 1, or any other expandable, steerable nozzle in accordance with the inventive concepts disclosed herein.

In the stored or compressed configuration shown in FIG. 2A, the nozzle 22 does not extend beyond a bounding surface 24. The bounding surface 24 is shown in dashed lines because it does not form part of the device 20 to which the nozzle 22 is operatively coupled. Rather, the bounding surface 24 is a boundary beyond which the device 20 does not extend, when the device 20 or the nozzle 22 (as the case may be) is stored prior to deployment.

In some embodiments, the bounding surface 24 is defined by an interior surface of a storage housing that envelops the device 20. In such embodiments, the interior surface of such a housing may compress the nozzle 22 into the stored configuration. Persons of ordinary skill in the art should understand how such a storage housing exerts a compressive force on the nozzle 22, even though FIG. 2A does not show a housing in physical contact with the nozzle 22.

In the case of an underwater vehicle, such a storage housing may be, for example, a cylindrical sonobuoy launch canister of molded plastic form manufactured from bonding multiple injection molded cylindrical sections together forming one long tube with a break-away muzzle cap and a launch initiating plunger. Alternate housings or launch canisters may include a cylindrical form made of PVC pipe or similar, metal pipe or tubing where the UUV is inserted directly. Persons of ordinary skill in the art may appreciate other storage housings that may be used in conjunction with devices disclosed herein, the respective interior surfaces of which each define a physical boundary beyond which a device housed therein cannot extend.

FIG. 2B shows the nozzle 22 in the deployed or expanded configuration. In the deployed configuration, the nozzle 22 has expanded so that it extends beyond the bounding surface 24. As may be seen by comparing FIGS. 2A and 2B, the nozzle 22 advantageously may be stored in a low-profile configuration for storage within a housing for the device 20, while obtaining a high-profile configuration for deployment outside the device housing.

As indicated in FIG. 2B, a nozzle 22 in the deployed configuration is opened so that a fluid traversing the nozzle 22 provides a thrust 26. The nozzle 22 may be situated within a recess 28 in the exterior surface of the device 20, to provide a component of this thrust 26 in a direction substantially parallel to the longitudinal axis of the device 20, and thereby stabilize or reduce a lateral motion of the device 20. As the nozzle 22 is steerable, the recess 28 of the surface of the device 20 may be symmetrically disposed about the axis of rotation of the nozzle 22, to thereby form a conical, parabolic, or otherwise rotationally-symmetric recess 28 in which the nozzle 22 is centrally located.

Alternately, the recess 28 may not be rotationally symmetric about the axis of rotation. Thus, the recess 28 may have a first shape forward of the nozzle 22 (i.e., toward the left of FIG. 2) and a second shape aft of the nozzle 22 (i.e., toward the right of FIG. 2). Such differing shapes may be a function of limits on the angular rotation of the nozzle 22. Persons having ordinary skill in the art may appreciate how the recess 28 may be shaped to optimize other parameters of the design of the device 20.

Figure 3C:
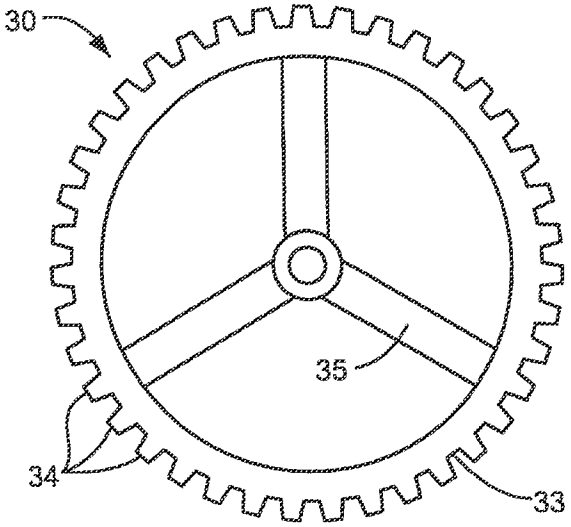
FIG. 3C is a bottom view of a first embodiment of an expandable, steerable nozzle.
Figure 3B:
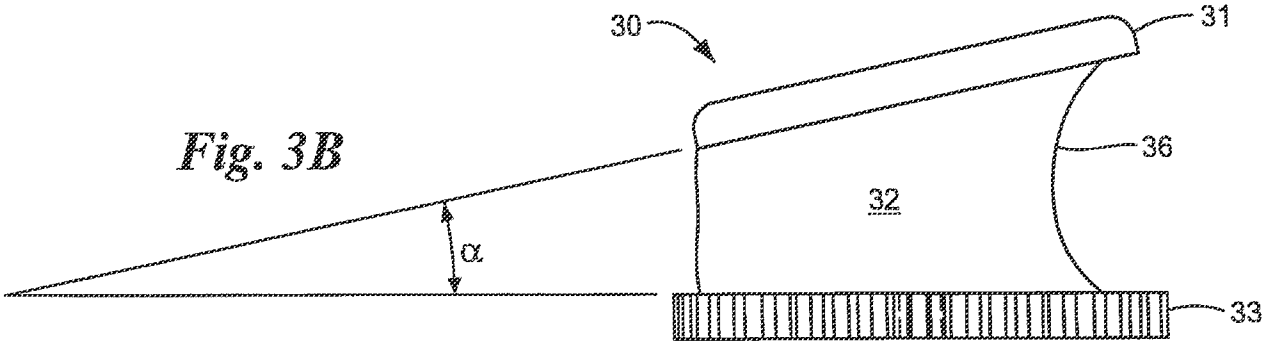
FIG. 3B is a right elevation view of a first embodiment of an expandable, steerable nozzle.
Figure 3A:
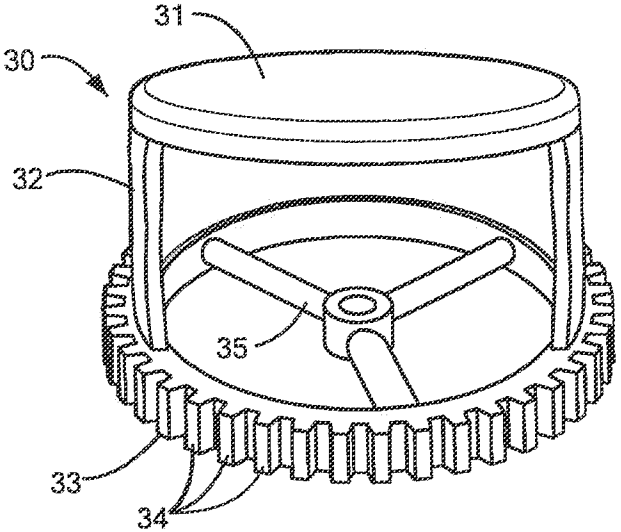
FIG. 3A is a front perspective view of a first embodiment of an expandable, steerable nozzle.

FIG. 3 shows a first embodiment of an expandable, steerable nozzle 30, separate from any device to which it may be coupled. FIG. 3 comprises a front perspective view 3A, a right elevation view 3B, and a bottom view 3C. FIG. 3A shows features of the nozzle 30, including a top rigid member 31, a flexible bellows 32, a bottom rigid member 33 having teeth 34, and a bearing 35.

The top rigid member 31 and the bottom rigid member 33 may be formed, for example, via 3D-printing using variable durometer plastics, while the flexible bellows 32 is formed using a rubber compound. Alternately, the top rigid member 31 and bottom rigid member 33 may be formed from hard plastic via injection molding. If this method of manufacturing is used, then the flexible bellows must be later bonded to these rigid members. One manner of doing so is by inserting the rigid members 31 and 33 into a second mold and forming the bellows 32 from a flexible rubber already bonded to the rigid members 31 and 33. Or, the bellows 32 may be made from a thin plastic membrane that is bonded to the rigid members 31 and 33 without using a mold. A person having ordinary skill in the art may appreciate other materials from which the nozzle 30 may be made, and associated techniques for making it.

In the deployed configuration shown in FIG. 3, the nozzle 30 operates as follows. Fluid perpendicularly traverses the bottom rigid member 33, flowing around the bearing 35, until it contacts the top rigid member 31. However, a bottom surface of the top rigid member 31 and a top surface of the bottom rigid member 33 form an operating angle α, as shown in FIG. 3B. Thus, the top rigid member 31 produces a reactive force on the moving fluid, redirecting the fluid so that it exits an opening 36 of the nozzle 30 at an angle of approximately a with respect to the top surface of the bottom rigid member 33. The flexible bellows 32 contains the fluid so that it exits the nozzle 30 in the direction of the opening 36. Conversely, the exiting fluid exerts a force on the top rigid member 31 and the bellows 32, which react to propel the nozzle 30 in a direction toward the left of FIG. 3B. In exemplary embodiments, the angle α of the deployed configuration is approximately 15 degrees, although it should be appreciated that other angles may be used.

Figure 5A:
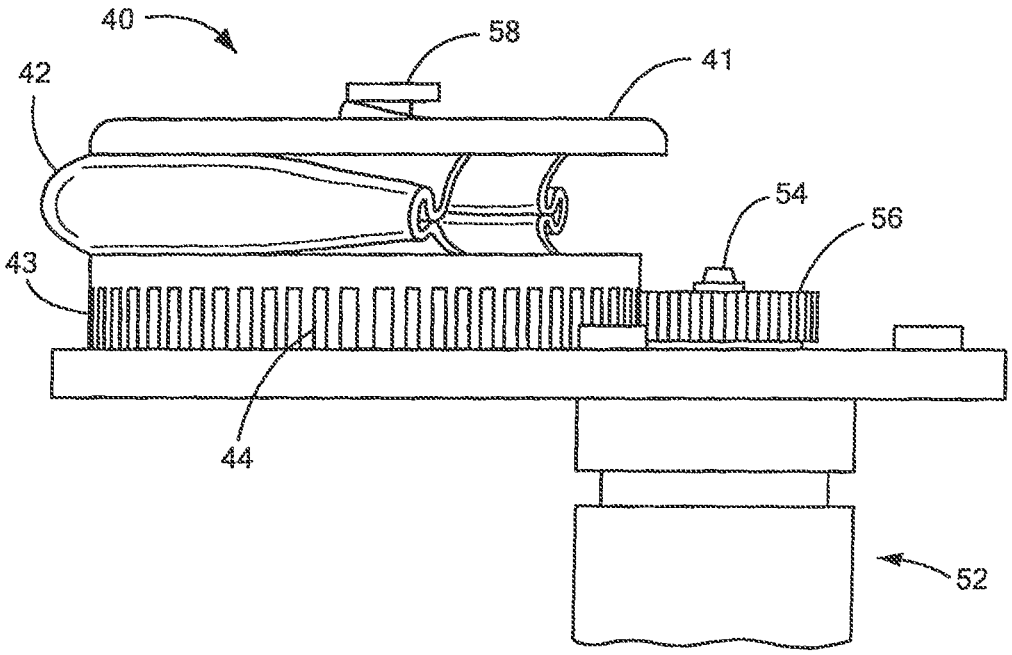
FIG. 5A is a right view of the stored configuration of the second embodiment of the nozzle coupled to a steering mechanism.
Figure 5B:
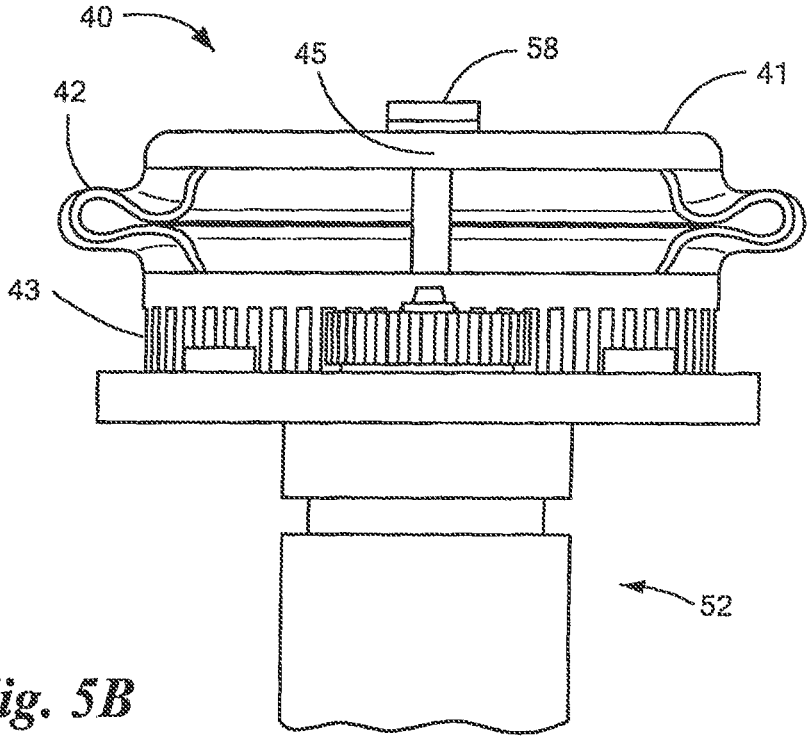
FIG. 5B is a front view of the stored configuration of the second embodiment of the nozzle coupled to a steering mechanism.
Figure 6A:
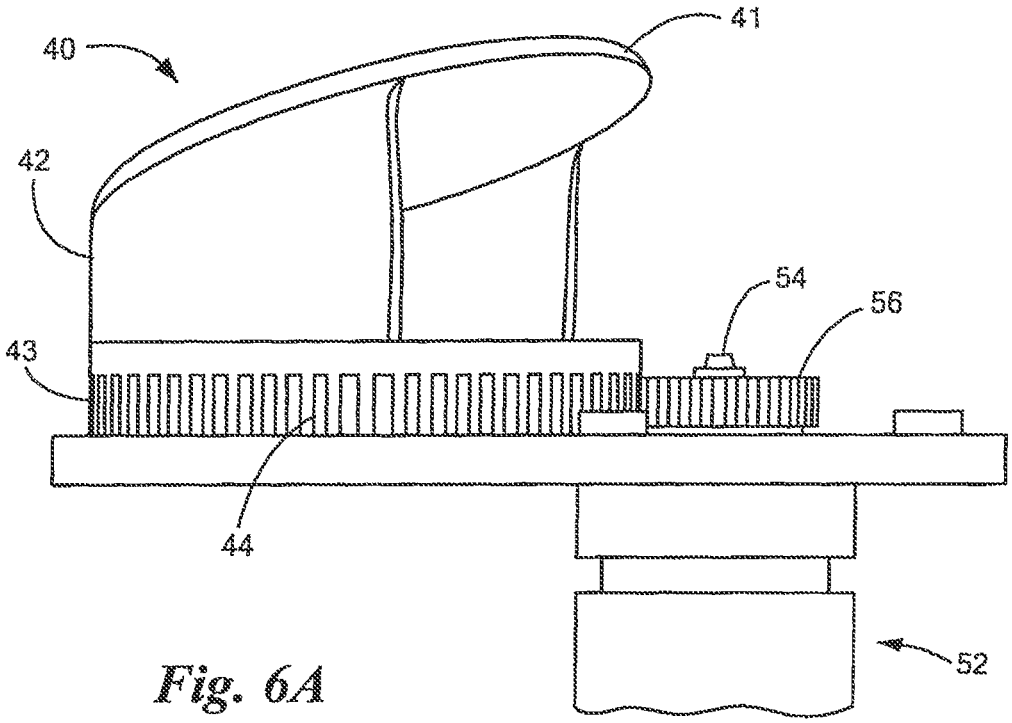
FIG. 6A is a right perspective view of the deployed configuration of the second embodiment of the nozzle coupled to the steering mechanism.
Figure 6B:
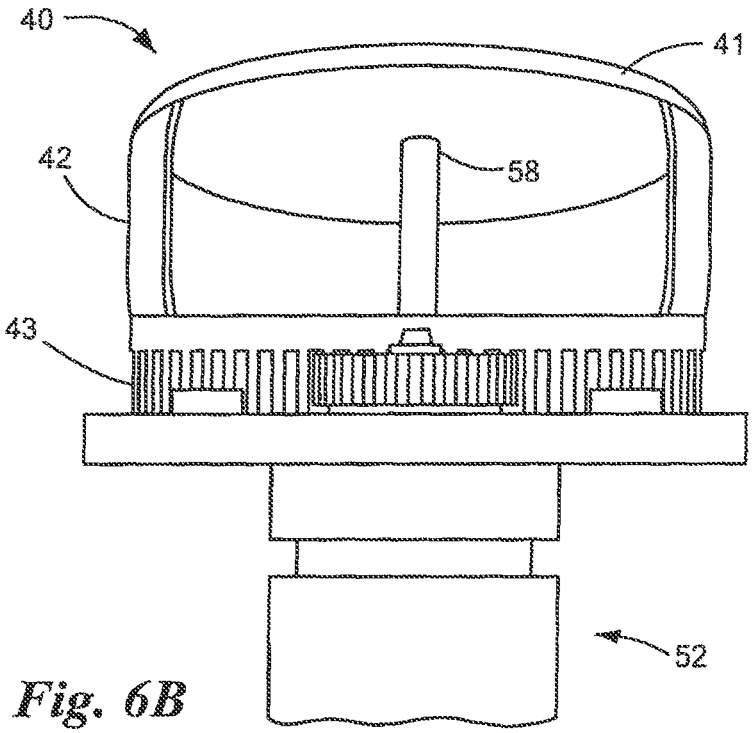
FIG. 6B is a front view of the deployed configuration of the second embodiment of the nozzle coupled to the steering mechanism.

In accordance with some embodiments, the nozzle 30 is steerable. Thus, the bottom rigid member 33 may be mounted to a device that has a steering mechanism for providing steering inputs to the nozzle 30. Such a device may be a UUV, described above in connection with FIG. 1, or other such device. For this purpose, the bottom rigid member 33 may be coupled to the steering mechanism. Thus, FIG. 3 shows bottom rigid member 33 having teeth 34, which may be coupled to a gear that forms part of the device's steering mechanism. This coupling is shown in FIGS. 5 and 6 and describe below in more detail. However, steering is possible using mechanical couplings between the nozzle 30 and a device other than gears, and persons having ordinary skill in the art may appreciate other steering mechanisms. In this connection, various embodiments of the nozzle 30 may lack the teeth 34, and instead use a different form of coupling. The nozzle 30 may be steered by direct drive from the central pivot point. The gear tooth interface alternately could be driven by a friction interface, such as direct contact between the bottom rigid member 33 and a driving spindle, or chain, or belt.

In accordance with some embodiments, the nozzle 30 is retained to the steering mechanism using a third rigid member (e.g. a headed pin) attached to the top rigid member 31. In the embodiment of FIG. 3, the pin is short and retains the nozzle 30 via the bearing 35 in the bottom rigid member 33, leaving the flexible bellows 32 to expand and compress easily. In this embodiment, the flexible bellows 32 must be structurally sufficient to handle sudden changes in the load from fluid flow redirection.

Figure 4A:
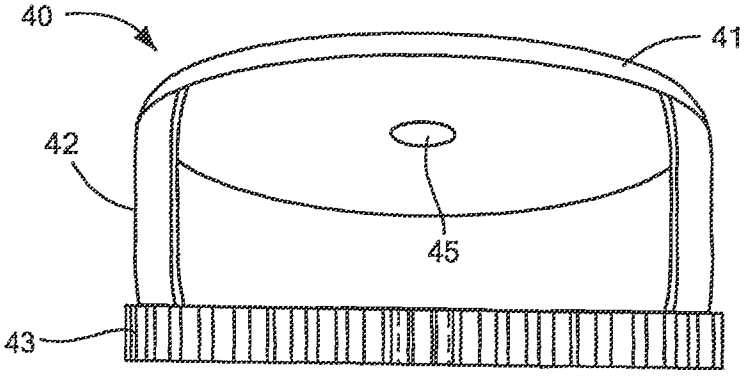
FIG. 4A is a front view of a second embodiment of an expandable, steerable nozzle.
Figure 4C:
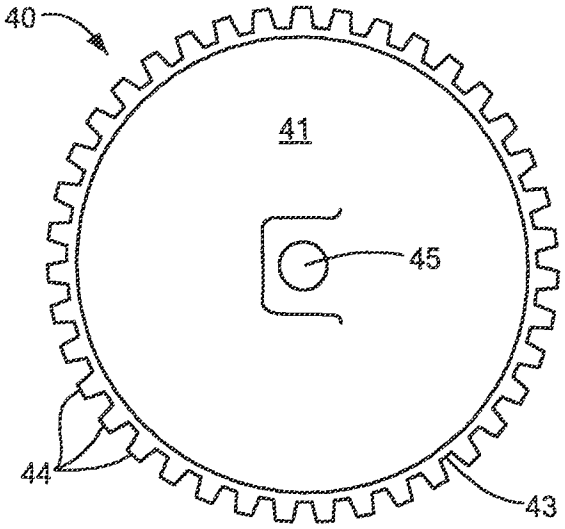
FIG. 4C is a top view of a second embodiment of an expandable steerable nozzle.
Figure 4B:
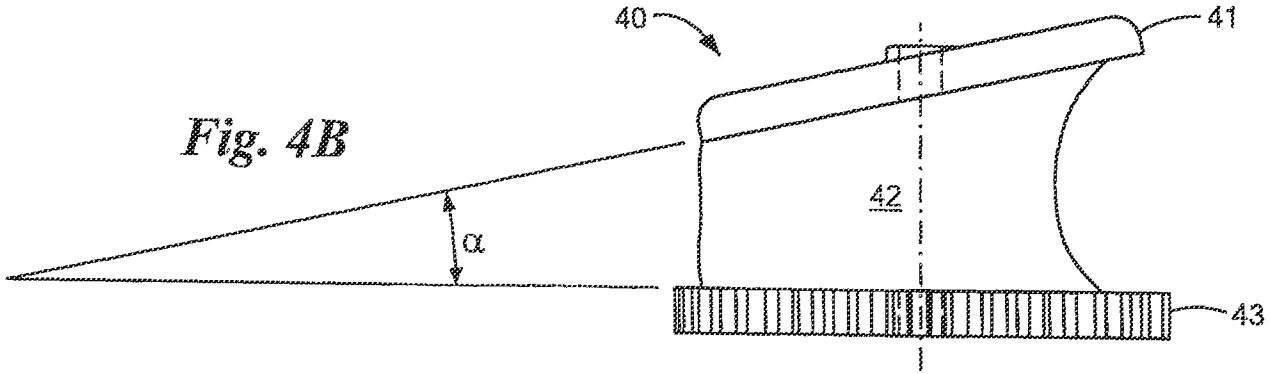
FIG. 4B is a right elevation view of a second embodiment of an expandable, steerable nozzle.

FIG. 4 shows a second embodiment of an expandable, steerable nozzle 40, and comprises a front view 4A, a right elevation view 4B, and a top view 4C. FIG. 4A shows several relevant features of the nozzle 40, including a top rigid member 41, a flexible bellows 42, and a bottom rigid member 43 having teeth 44. Each of these structural components is like a corresponding component of the first embodiment shown in FIG. 3 and described above.

FIG. 4 also shows a bearing 45. To retain the nozzle 40 to the vehicle, a third rigid member (e.g. a headed pin) may be attached to the top rigid member 41 through the bearing 45 in the top rigid member 41. In this embodiment, the head of the pin bears the load from fluid flow redirection, so the flexible bellows 42 is relieved from sudden changes in load. Thus, the flexible bellows 42 may be made from a weaker material.

The third rigid member, shown in FIGS. 5 and 6, may be a metallic rod operatively coupled to an angle controlling system of the device to which the nozzle 40 is attached. Using such a coupling, the angle controlling system may exert positive control over the operating angle α, shown in FIG. 4B, between a bottom surface of the top rigid member 41 and a top surface of the bottom rigid member 43 by movement of the third rigid member. A bearing, such as the bearing 35 described above, may be used to restrict lateral movement of the third rigid member. However, it should be appreciated that various embodiments of the nozzle 40 (and of the nozzle 30) may lack such a third rigid member, a bearing, or both, if positive control over the operating angle a is not desired during deployment.

FIG. 5 shows the stored configuration of the nozzle 40 coupled to a steering mechanism 52, in a right view 5A and a front view 5B. FIG. 5 may be understood as a cutaway view of FIG. 2A, in which an exterior surface of the device 20 has been removed to reveal only the nozzle 40 and the steering mechanism 52. As described above, the steering mechanism of FIG. 5 is a gear 54 having teeth 56, to which the bottom rigid member 43 of the nozzle 40 is operatively coupled via intermeshing teeth 44. Illustrated in FIG. 5 is a third rigid member 58, which is coupled to the top rigid member 41 of the nozzle 40 through the hole 45 to retain the nozzle 40 to the steering mechanism and to control the operating angle of the nozzle 40.

FIG. 6 shows the deployed configuration of the nozzle 40 coupled to the steering mechanism 52, in a right perspective view 6A and a front view 6B. FIG. 6 may be understood as a cutaway view of FIG. 2B, in which an exterior surface of the device 20 has been removed to reveal only the nozzle 40 and the steering mechanism 52. As described above, the steering mechanism of FIG. 6 is a gear 54 having teeth 56, to which the bottom rigid member 43 of the nozzle 40 is operatively coupled via intermeshing teeth 44. Illustrated in FIG. 6 is a third rigid member 58, which is coupled to the top rigid member 41 of the nozzle 40 to retain the nozzle 40 to the steering mechanism and to control the operating angle of the nozzle 40.

Note that in FIG. 5, the third rigid member 58 is in a retracted configuration, while in FIG. 6 it is in an extended configuration. Persons having ordinary skill in the art should appreciate that extending the third rigid member 58 increases the operating angle α (as shown in FIGS. 3 and 4), while retracting the third rigid member 58 reduces the operating angle α. Thus, an angle controlling system of the device 20 may provide precise control over the operating angle α, provided the distance of such an extension or retraction has been appropriately calibrated to the geometry of the nozzle 40. Such a calibration may be performed in advance of deployment, while the device 20 (and nozzle 40) are in a stored configuration. Calibration of a force required to move the third rigid member 58 likewise may be performed in advance of deployment, or alternately may be performed while the device 20 and nozzle 40 are in a deployed configuration, using feedback provided by environmental sensors (not shown) that sense actual operating conditions.

Figure 7:
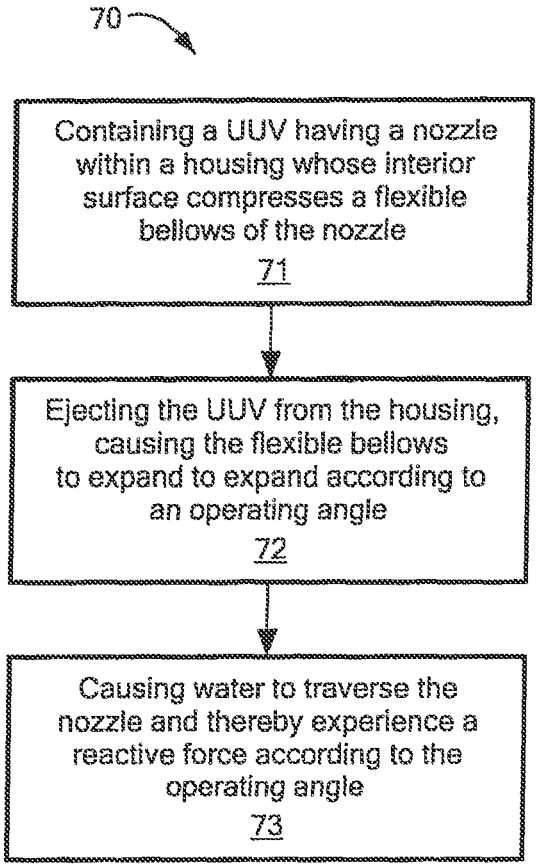
FIG. 7 is a flow diagram for a method of operating an underwater vehicle having an expandable, steerable nozzle in accordance with an embodiment of the invention.

FIG. 7 is a flow diagram for a method 70 of operating an underwater vehicle having an expandable, steerable nozzle in accordance with an embodiment of the invention. The underwater vehicle may be, for example, the UUV 10 shown in FIG. 1, or another underwater vehicle. The nozzle itself has three components. The first component is a first rigid member operatively coupled to a steering mechanism of the underwater vehicle. The second component is a second rigid member. The third component is a flexible bellows coupling the first rigid member to the second rigid member according to a configurable operating angle. Thus, for example, the nozzle may be a nozzle 12, 22, 30, or 40 described above, although the underwater vehicle of FIG. 7 is not necessarily so limited.

A first process 71 includes containing the UUV within a housing. Containing the UUV includes compressing a flexible bellows of the nozzle by an interior surface of the housing into a stored configuration. So contained, the underwater vehicle may be easily stored and, if necessary, transported to the proximity of its deployment location. It should be appreciated that, in one embodiment the underwater vehicle is provided already housed within the housing and wherein the flexible bellows is already compressed into the stored configuration. In an alternate embodiment, the housing and underwater vehicle are provided separately, and process 71 includes placing the underwater vehicle inside the housing.

A second process 72 ejects the UUV from the housing. Ejection may be performed according to a variety of techniques known in the art. For example, the UUV may be ejected using an explosive charge that forces a piston against the aft end of the UUV and pushes it out of the housing. An alternate method of ejecting includes first orienting the housing at a downward angle, then opening a hatch that allows the UUV to slide out of the housing due to gravity. In accordance with various embodiments, ejection directly causes the flexible bellows, previously compressed into the stored configuration, to automatically expand into a deployed configuration. Such expansion may be caused by one or more factors, such as the flexibility and spring force of the bellows, or a fluid traversing the nozzle in accordance with the normal operation of the underwater vehicle. In any event, expansion of the flexible bellows causes the first and second rigid members to obtain an operating angle between them, so that water traversing the first rigid member produces a reactive force according to the operating angle upon contacting the second rigid member.

A third process 73 includes causing water to traverse the nozzle to produce a reactive force according to the operating angle. In more detail, water traverses the first rigid member and contacts the second rigid member, which is positioned according to the operating angle—such contact causes a reactive force, as described above in connection with FIG. 3. In this way, the water is redirected to exit the nozzle, and the reactive force propels the UUV.

A position or orientation of the underwater vehicle may be controlled, after ejection, in a variety of ways that use the capabilities of expandable, steerable nozzles as described above. Thus, for example, causing water to traverse the nozzle may provide a propulsive thrust. Also, an underwater vehicle having several such steerable nozzles may be configured to independently steer the nozzles or vary their respective operating angles. Moreover, an underwater vehicle advantageously may automatically perform any combination of these techniques according to a guidance objective. Such an objective may be, for example, keeping station in rough or turbulent waters, or navigating toward a target of interest according to a navigation solution. It should be appreciated that such automatic control may require the underwater vehicle to have several expandable, steerable nozzles, as well as components known in the art but not otherwise described herein, such as a navigational computer, various sensors, and so on.

The techniques and structures described herein may be implemented in any of a variety of different forms. For example, features of the invention may be embodied within various forms of communication devices, both wired and wireless; television sets; set top boxes; audio/video devices; laptop, palmtop, desktop, and tablet computers with or without wireless capability; personal digital assistants (PDAs); telephones; pagers; satellite communicators; cameras having communication capability; network interface cards (NICs) and other network interface structures; base stations; access points; integrated circuits; as instructions and/or data structures stored on machine readable media; and/or in other formats. Examples of different types of machine readable media that may be used include floppy diskettes, hard disks, optical disks, compact disc read only memories (CD-ROMs), digital video disks (DVDs), Blu-ray disks, magneto-optical disks, read only memories (ROMs), random access memories (RAMs), erasable programmable ROMs (EPROMs), electrically erasable programmable ROMs (EEPROMs), magnetic or optical cards, flash memory, and/or other types of media suitable for storing electronic instructions or data.

In the foregoing detailed description, various features of the invention are grouped together in one or more individual embodiments to streamline the disclosure. This method of disclosure is not to be interpreted as reflecting an intention that the claimed invention requires more features than are expressly recited in each claim. Rather, inventive aspects may lie in less than all features of each disclosed embodiment.

Having described implementations which serve to illustrate various concepts, structures, and techniques which are the subject of this disclosure, it will now become apparent to those of ordinary skill in the art that other implementations incorporating these concepts, structures, and techniques may be used. Accordingly, it is submitted that that scope of the patent should not be limited to the described implementations but rather should be limited only by the spirit and scope of the following claims.

What is claimed is:

1. An expandable, steerable nozzle for a device, the nozzle comprising:

a rigid ring mounted to the device and operatively coupled to a steering mechanism of the device;

a rigid plate; and a flexible bellows coupling the ring to the plate according to a configurable operating angle, so that a fluid traversing the ring and contacting the plate produces a reactive force according to the operating angle;

wherein the flexible bellows has a first configuration in which the nozzle does not extend beyond an exterior surface of the device, and a second configuration in which the nozzle extends beyond the exterior surface of the device.

2. A nozzle according to claim 1, wherein either or both of the ring and the plate comprises a plastic, a metal, a composite material, or any combination of these.

3. A nozzle according to claim 1, wherein the flexible bellows comprises a rubber, a flexible plastic, a fabric, or any combination of these.

4. A nozzle according to claim 1, wherein the steering mechanism of the device comprises a gear, and the ring has teeth that mesh with teeth of the gear.

5. A nozzle according to claim 1, wherein the flexible bellows is shaped so that, in the second configuration, the operating angle is between 0 and 90 degrees.

6. A nozzle according to claim 5, wherein the operating angle is approximately 15 degrees.

7. A nozzle according to claim 1, further comprising a rod for retaining the nozzle to the steering mechanism, the rod mechanically coupled to the plate.

8. A nozzle according to claim 7, wherein the ring comprises a bearing for the rod.

9. A nozzle according to claim 7, wherein the rod comprises a metal, a plastic, a composite material, or any combination of these.

10. An unmanned underwater vehicle (UUV) comprising:

a steering mechanism; and an expandable, steerable nozzle having:

a rigid ring operatively coupled to the steering mechanism;

a rigid plate; and a flexible bellows coupling the ring to the plate according to a configurable operating angle, so that a fluid traversing the ring and contacting the plate produces a reactive force according to the operating angle;

wherein the flexible bellows has a first configuration in which the nozzle does not extend beyond an exterior surface of the UUV, and a second configuration in which the nozzle extends beyond the exterior surface of the UUV.

11. A vehicle according to claim 10, wherein either or both of the ring and the plate comprises a plastic, a metal, a composite material, or any combination of these.

12. A vehicle according to claim 10, wherein the flexible bellows comprises a rubber, a flexible plastic, a fabric, or any combination of these.

13. A vehicle according to claim 10, wherein the steering mechanism of the device comprises a gear, and the ring has teeth that mesh with teeth of the gear.

14. A vehicle according to claim 10, wherein the flexible bellows is shaped so that, in the second configuration, the operating angle is between 0 and 90degrees.

15. A vehicle according to claim 14, wherein the operating angle is approximately 15 degrees.

16. A vehicle according to claim 10, further comprising a rod for retaining the nozzle to the steering mechanism, the rod mechanically coupled to the plate.

17. A vehicle according to claim 16, wherein the ring comprises a bearing for the rod.

18. A vehicle according to claim 16, wherein the rod comprises a metal, a plastic, a composite material, or any combination of these.

19. A method of operating an unmanned underwater vehicle (UUV), the method comprising:

containing the UUV within a housing, the UUV comprising a steering mechanism and an expandable, steerable nozzle having (a) a rigid ring operatively coupled to the steering mechanism, (b) a rigid plate, and (c) a flexible bellows coupling the ring to the plate according to a configurable operating angle;

wherein containing the UUV includes compressing, by an interior surface of the housing, the flexible bellows into a first configuration; and ejecting the UUV from the housing, thereby causing the flexible bellows to expand into a second configuration having a different operating angle than the first configuration;

wherein when the flexible bellows is in the second configuration, water traversing the rings and contacting the plate produces a reactive force for steering the UUV according to the operating angle.

20. A method according to claim 19, further comprising controlling a position or orientation of the underwater vehicle according to a guidance objective by automatically varying a volume of the water traversing the ring, automatically steering the reactive force using the steering mechanism, automatically varying the operating angle of the flexible bellows, or any combination thereof.

* * * * *